US011009270B2

(12) United States Patent
Dong et al.

(10) Patent No.: US 11,009,270 B2
(45) Date of Patent: May 18, 2021

(54) HEAT PUMP AIR CONDITIONING SYSTEM AND CONTROL METHOD

(71) Applicant: GREE ELECTRIC APPLIANCES, INC. OF ZHUHAI, Zhuhai (CN)

(72) Inventors: Mingzhu Dong, Zhuhai (CN); Jianming Tan, Zhuhai (CN); Guanghui Xia, Zhuhai (CN); Bo Liang, Zhuhai (CN); Xianlin Wang, Zhuhai (CN); Xiaocheng Lai, Zhuhai (CN); Junhong Wu, Zhuhai (CN); Guangqian Peng, Zhuhai (CN); Xu Gao, Zhuhai (CN); Zhiwei Chen, Zhuhai (CN); Bo Yu, Zhuhai (CN); Wen Che, Zhuhai (CN); Xiaoyu Li, Zhuhai (CN)

(73) Assignee: GREE ELECTRIC APPLIANCES, INC. OF ZHUHAI, Zhuhai (CN)

( * ) Notice: Subject to any disclaimer, the term of this patent is extended or adjusted under 35 U.S.C. 154(b) by 0 days.

(21) Appl. No.: 16/965,017

(22) PCT Filed: Jan. 31, 2018

(86) PCT No.: PCT/CN2018/074637
§ 371 (c)(1),
(2) Date: Jul. 27, 2020

(87) PCT Pub. No.: WO2019/144421
PCT Pub. Date: Aug. 1, 2019

(65) Prior Publication Data

US 2020/0348053 A1 Nov. 5, 2020

(30) Foreign Application Priority Data

Jan. 25, 2018 (CN) ..... 201810071040.3

(51) Int. Cl.
*F25B 13/00* (2006.01)
*F25B 47/02* (2006.01)
*F25B 41/20* (2021.01)

(52) U.S. Cl.
CPC ..... *F25B 13/00* (2013.01); *F25B 41/20* (2021.01); *F25B 47/025* (2013.01); *F25B 2313/02741* (2013.01); *F25B 2600/25* (2013.01)

(58) Field of Classification Search
CPC ..... F25B 13/00; F25B 41/04; F25B 47/025; F25B 2313/02741; F25B 2600/25;
(Continued)

(56) References Cited

U.S. PATENT DOCUMENTS 4,727,726 A 3/1988 Mitani et al.
5,165,250 A * 11/1992 Nagatomo ..... F25B 13/00 62/158

(Continued)

FOREIGN PATENT DOCUMENTS

DE 102012004094 B3 6/2013

OTHER PUBLICATIONS

European Search Report dated Feb. 1, 2021(corresponding application No. 18902577.8).

*Primary Examiner* — Emmanuel E Duke
(74) *Attorney, Agent, or Firm* — Kilpatrick Townsend & Stockton, LLP

(57) ABSTRACT

A heat pump air conditioning system and a control method. The heat pump air conditioning system includes: a compressor; an indoor unit heat exchanger, an outdoor unit heat exchanger and a throttling device; a refrigerant circulation loop, connecting the compressor, the indoor unit heat exchanger, the outdoor unit heat exchanger and the throttling device in series; the heat storage module, disposed in the
(Continued)

refrigerant circulation loop and configured to absorb heat from refrigerant in the refrigerant circulation loop and store heat when heat storage is required, and to heat the refrigerant in the refrigerant circulation loop when the outdoor unit heat exchanger defrosting is required. The heat pump air conditioning system can store excess heat of the system for defrosting when indoor heat load is low, and release heat for defrosting by means of the heat storage module during a defrosting process while continuing supplying heat to a room.

18 Claims, 7 Drawing Sheets

(58) Field of Classification Search
CPC .. F25B 2600/2501; F25B 30/00; F25B 30/02; F25B 47/02; F25B 47/022; F24F 11/41
See application file for complete search history.

(56) References Cited

U.S. PATENT DOCUMENTS

| | | | | |
|---|---|---|---|---|
| 6,260,367 | B1 * | 7/2001 | Furuya | F25B 9/008 62/197 |
| 2012/0042678 | A1 * | 2/2012 | Park | F25B 29/003 62/324.1 |
| 2015/0089971 | A1 * | 4/2015 | Furui | F25D 16/00 62/434 |

* cited by examiner

HEAT PUMP AIR CONDITIONING SYSTEM AND CONTROL METHOD

CROSS REFERENCE TO RELATED APPLICATIONS

This application claims all benefits accruing under 35 U.S.C. § 119 from China Patent Application No. 201810071040.3, filed on Jan. 25, 2018 in the China National Intellectual Property Administration, the entire content of which is hereby incorporated by reference. This application is a national phase under 35 U.S.C. § 120 of international patent application PCT/CN2018/074637, entitled "HEAT PUMP AIR CONDITIONING SYSTEM AND CONTROL METHOD" filed on Jan. 31, 2018, the content of which is also hereby incorporated by reference.

TECHNICAL FIELD

The present application belongs to the technical field of air conditioning, and in particular relates to a heat pump air conditioning system and a control method.

BACKGROUND

Existing defrosting modes of heat pump air conditioners mainly include two modes: refrigeration cycle defrosting and hot gas defrosting. The refrigeration cycle defrosting is performed by switching the system from a heating cycle to the refrigeration cycle for defrosting by means of a four-way selector valve. The hot gas defrosting is performed by increasing a rate of flow of an expansion valve under the heating cycle to make the high-temperature refrigerant enter the condenser to defrost. In both defrosting modes, heat can not be supplied to a room, which will cause the room temperature to drop and affect comfort of the room. Especially in the refrigeration cycle defrosting mode, an indoor heat exchanger acts as an evaporator during defrosting, which will absorb indoor heat.

The heat pump air conditioner in the prior art cannot supply heat to the room during a defrosting process, resulting in technical problems such as a drop in room temperature and affecting the comfort of the room, therefore the present application studies and provides a heat pump air conditioning system and a control method.

SUMMARY

Therefore, the technical problem to be solved by the present application is to overcome the defect that the heat pump air conditioner in the prior art cannot supply heat to a room during a defrosting process, resulting in a drop in room temperature and affecting comfort of the room, therefore a heat pump air conditioning system and a control method are provided.

The present application provides a heat pump air conditioning system, including:

a compressor;

an indoor unit heat exchanger, an outer unit heat exchanger and a throttling device;

a refrigerant circulation loop, connecting the compressor, the indoor unit heat exchanger, the outer unit heat exchanger and the throttling device in series;

a heat storage module disposed in the refrigerant circulation loop and configured to absorb heat from a refrigerant in the refrigerant circulation loop and store heat when heat storage is required, and to heat the refrigerant in the refrigerant circulation loop when the outer unit heat exchanger defrosting is required.

In an embodiment, a pipeline between the outer unit heat exchanger and the throttling device is a first pipeline, and the heat storage module is connected and arranged on the first pipeline between the outer unit heat exchanger and the throttling device; or a pipeline between the outer unit heat exchanger and a suction port of the compressor is a first pipeline, and the heat storage module is connected to and arranged on the first pipeline.

In an embodiment, a first parallel pipeline is arranged at both ends of the heat storage module in parallel; one end of the first parallel pipeline is connected to a first position of the first pipeline, where one end of the heat storage module is located; another end of the first parallel pipeline is connected to a second position of the first pipe, where another end of the heat storage module is located; a first control valve is further provided and configured to control one of the heat storage module and the first parallel pipeline to be open and control another to be closed.

In an embodiment, the first control valve is a first three-way valve, and is disposed at a position where the first parallel pipeline and the first pipeline are connected.

In an embodiment, the system further includes a four-way valve; the four-way valve includes a first connection end, a second connection end, a third connection end and a fourth connection end; the first connection end and the indoor unit heat exchanger are connected; the second connection end and an exhaust port of the compressor are connected; the third connection end and the outer unit heat exchanger are connected; and the fourth connection end and the suction port of the compressor are connected.

In an embodiment, a connection pipeline between the second connection end of the four-way valve; and the exhaust port of the compressor is a second pipeline; the heat storage module is disposed on the second pipeline as well; and the second pipeline passes through the heat storage module.

In an embodiment, a second parallel pipeline is arranged at both ends of the heat storage module in parallel; one end of the second parallel pipeline is connected to a first position of the second pipeline, where one end of the heat storage module is located; another end of the second parallel pipeline is connected to a second position of the second pipeline, where another end of the heat storage module is located; and a second control valve is further provided and configured to control one of the heat storage module and the second parallel pipeline to be open and control another to be closed.

In an embodiment, the second control valve is a second three-way valve, and is disposed at a position where the second parallel pipeline and the second pipeline are connected.

In an embodiment, the indoor unit heat exchanger further includes an indoor unit fan.

The present application further provides a control method for an air conditioning system; the control method is applied to any one of the heat pump air conditioning systems described above, and performs switching control for modes of refrigeration, heating, heating and heat storage, refrigeration and heat storage, defrosting alone, and heating and defrosting.

In an embodiment, when the refrigeration is performed, the four-way valve is controlled to regulate the indoor unit heat exchanger to be in communication with the suction port of the compressor, and the first parallel pipeline and the second parallel pipeline are controlled to be open;

the heating is performed, the four-way valve is controlled to regulate the indoor unit heat exchanger to be in communication with the exhaust port of the compressor, and the first parallel pipeline and the second parallel pipeline are controlled to be open;

when the refrigeration and the heat storage are performed, the four-way valve is controlled to regulate the indoor unit heat exchanger to be in communication with the suction port of the compressor; the first parallel pipeline is controlled to be open; and the second parallel pipeline is controlled to be closed;

when the heating and the heat storage are performed, the four-way valve is controlled to regulate the indoor unit heat exchanger to be in communication with the exhaust port of the compressor; the first parallel pipeline is controlled to be open; and the second parallel pipeline is controlled to be closed;

when the defrosting alone is performed, the four-way valve is controlled to regulate the indoor unit heat exchanger to be in communication with the suction port of the compressor; the first parallel pipeline is controlled to be closed; and the second parallel pipeline is controlled to be closed or open;

when the heating and the defrosting are performed, the four-way valve is controlled to regulate the indoor unit heat exchanger to be in communication with the exhaust port of the compressor; the first parallel pipeline is controlled to be closed; and the second parallel pipeline is controlled to be closed or open.

In an embodiment, when the defrosting alone is performed, the indoor unit fan is controlled to be turned off; and when the heating and the defrosting are performed, the indoor unit fan is controlled to be turned on.

The heat pump air conditioning system and the control method provided by the present application have the following beneficial effects:

1. In the heat pump air conditioning system and the control method of the present application, by arranging the heat storage module in the refrigerant circulation loop, the heat storage module absorbs heat from the refrigerant in the refrigerant circulation loop and stores heat when heat storage is required, and heats the refrigerant in the refrigerant circulation loop when the outdoor unit heat exchanger needs to be defrosted, so that excess heat of the system can be stored for defrosting when an indoor heat load is low. During the defrosting process, heat is released by the heat storage module for defrosting. At this time, the heat can be continuously supplied to a room to ensure that room temperature remains unchanged, improving comfort of the room; moreover, when the indoor heat load is high, a heat demand can be guaranteed preferentially, and the four-way selector valve does not need to be reversed.

2. In the heat pump air conditioning system and the control method of the present application, by providing the heat storage module, exhaust gas of the compressor can be controlled by the second control valve to flow through the heat storage module or not. When the indoor heat load is less than the heat supply capacity of the system, the exhaust gas of the compressor flows through the heat storage module, and the heat storage module absorbs the heat of the exhaust gas of the compressor and stores the excess heat of the storage system. When the indoor heat load is greater than or equal to the heat supply capacity of the system, the exhaust gas of the compressor does not flow through the heat storage module, but flows directly into the indoor unit heat exchanger to supply heat to the room, thus achieving a selection of controlling the refrigerant to flow through the heat storage module or not according to a magnitude of the load, and achieving functions and effects that heat is not stored when the load is large, and that heat is stored when the load is small.

3. In the heat pump air conditioning system and the control method of the present application, by providing the first control valve and the first parallel pipeline between the throttling device and the outdoor unit heat exchanger, or configuring the pipeline between the outdoor unit heat exchanger and the suction port of the compressor as the first pipeline, the refrigerant from the indoor unit heat exchanger can be controlled by the first control valve to flow through the heat storage module first or not after flowing through an expansion valve. During defrosting, the refrigerant from the indoor unit heat exchanger flows through the expansion valve and enters the heat storage module to absorb heat, and then flows into the outdoor unit heat exchanger, releasing heat and defrosting the outdoor unit heat exchange. During heating, the refrigerant from the indoor unit heat exchanger flows through the expansion valve and directly flows into the outdoor unit heat exchanger to absorb heat, thus achieving an effective control of whether heat is absorbed from the heat storage module for defrosting (the heat storage module is turned off during conventional heating and refrigeration).

DETAILED DESCRIPTION OF EMBODIMENTS

Figure 1:
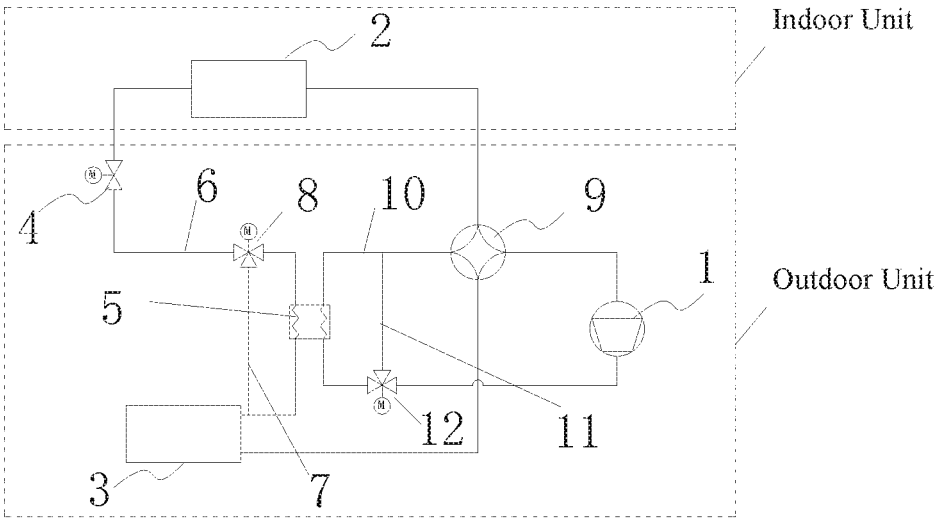
FIG. 1 is a schematic structural diagram illustrating a process flow of the heat pump air conditioning system of the present application.
Figure 2:
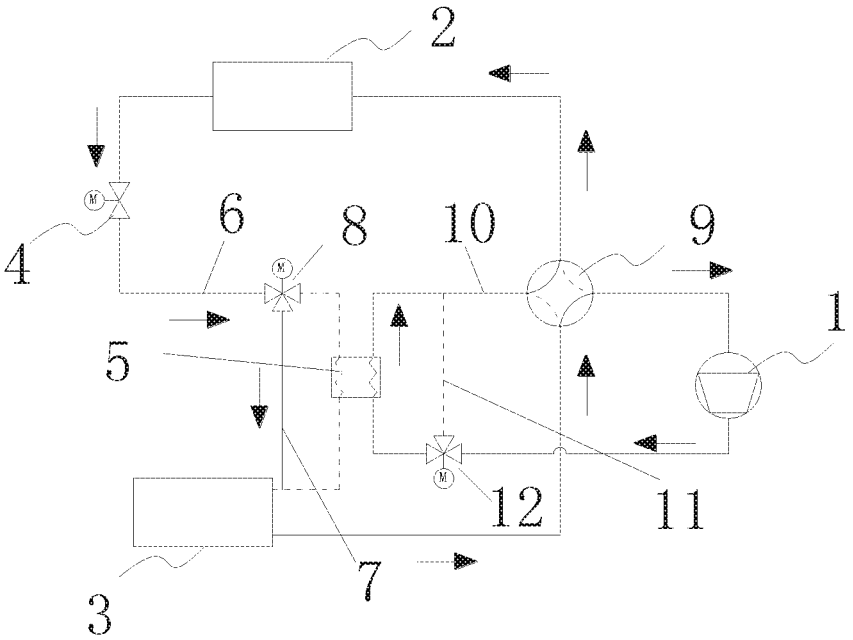
FIG. 2 is a schematic diagram illustrating the process flow of heating together with heat storage of the heat pump air conditioning system of the present application.
Figure 3:
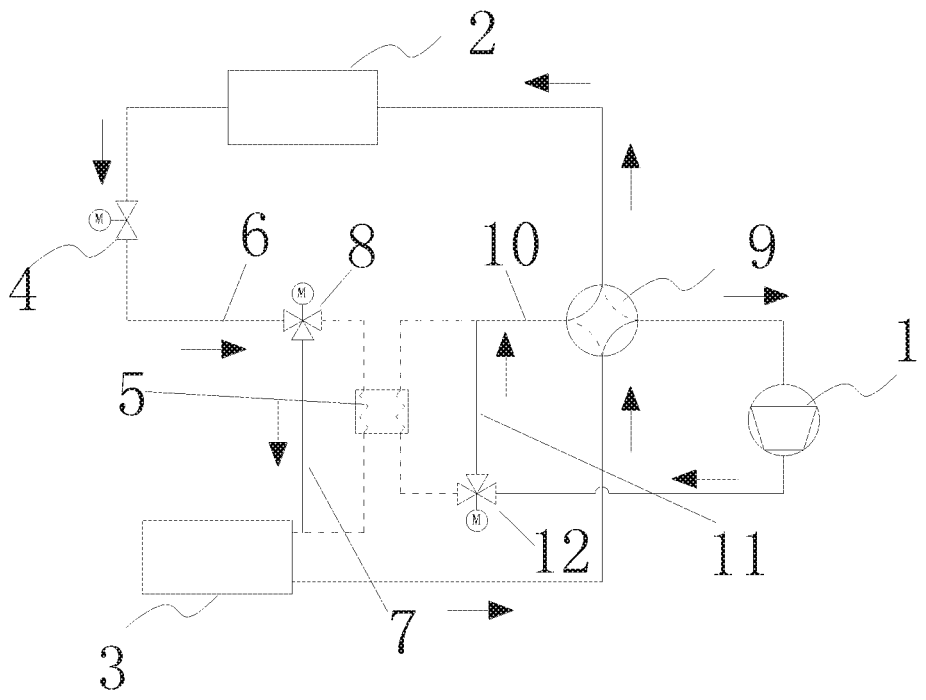
FIG. 3 is a schematic diagram illustrating the process flow of the heating without heat storage of the heat pump air conditioning system of the present application.
Figure 4:
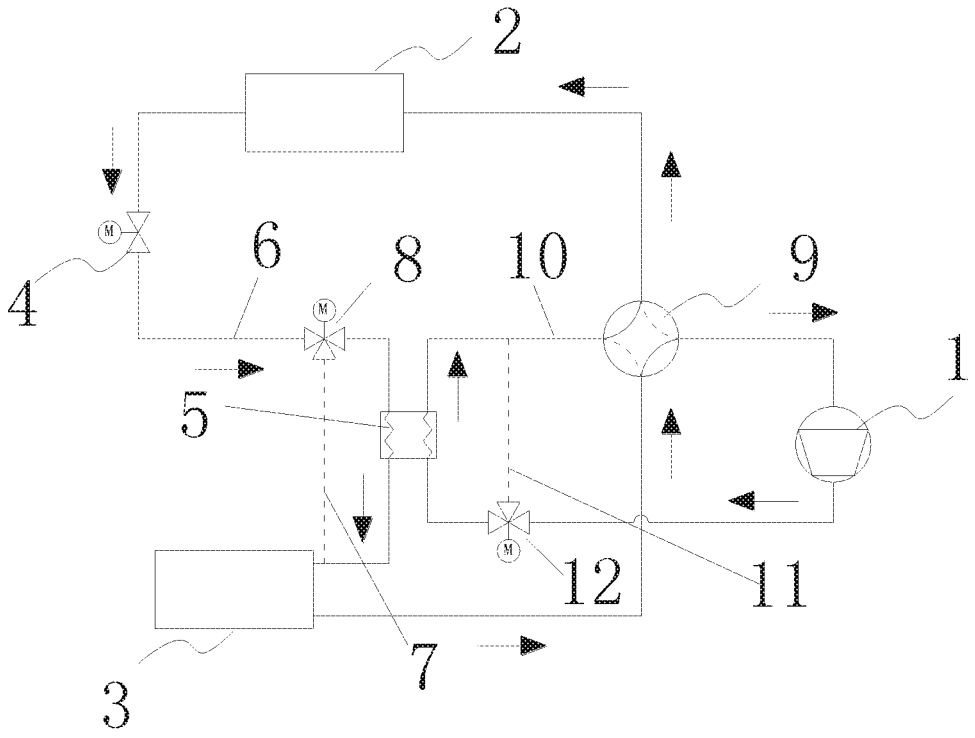
FIG. 4 is a schematic diagram illustrating the process flow of a first defrosting mode (heating together with defrosting and heat storage) of the heat pump air conditioning system of the present application.
Figure 5:
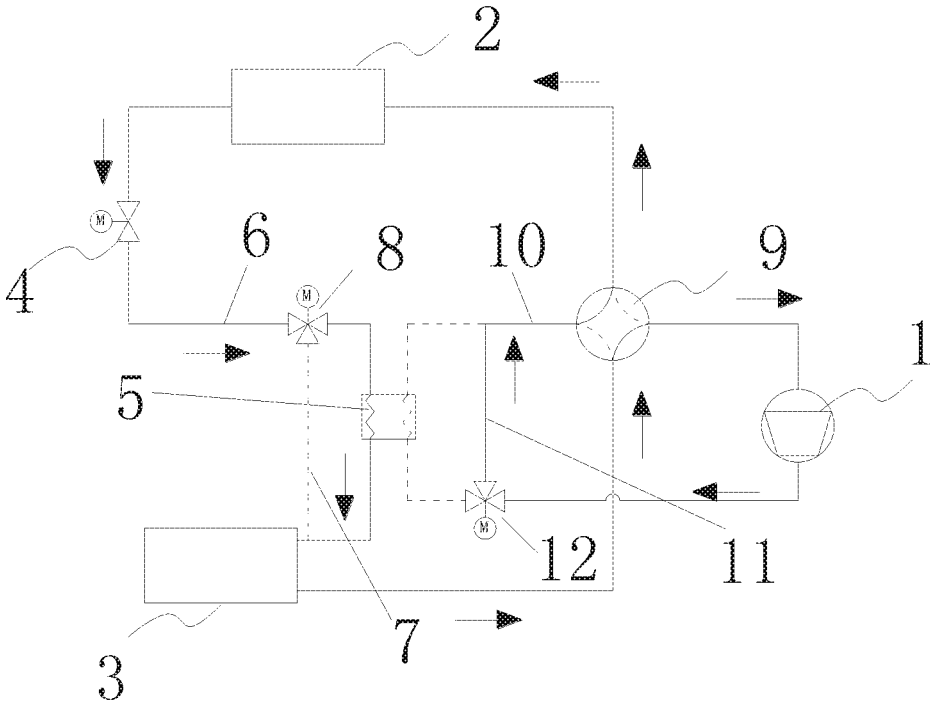
FIG. 5 is a schematic diagram illustrating the process flow of a second defrosting mode (heating and defrosting without heat storage) of the heat pump air conditioning system of the present application.
Figure 6:
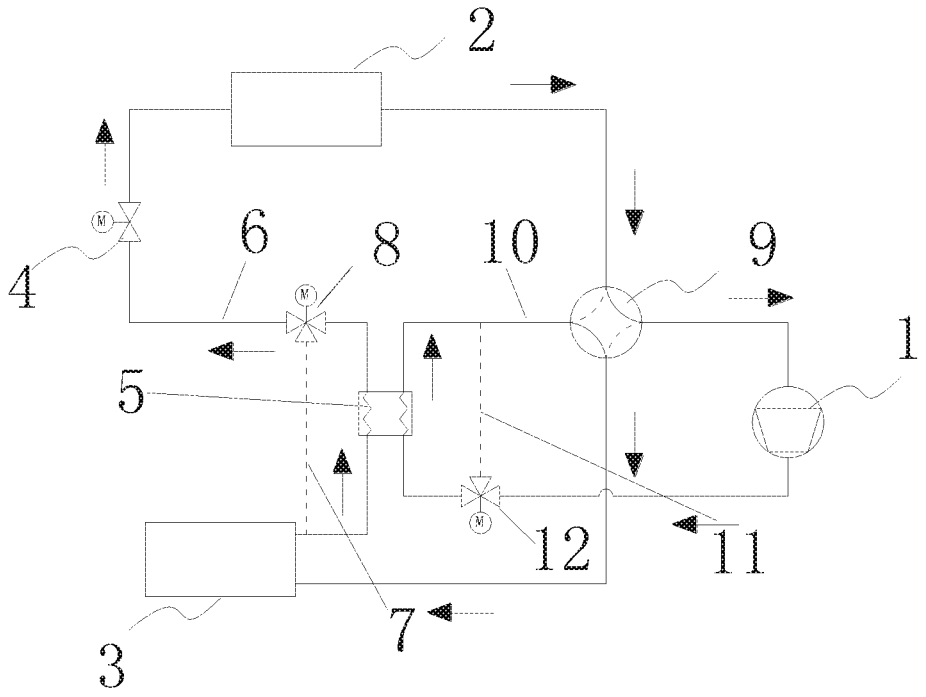
FIG. 6 is a schematic diagram illustrating the process flow of a third defrosting mode (defrosting alone and heat storage) of the heat pump air conditioning system of the present application.
Figure 7:
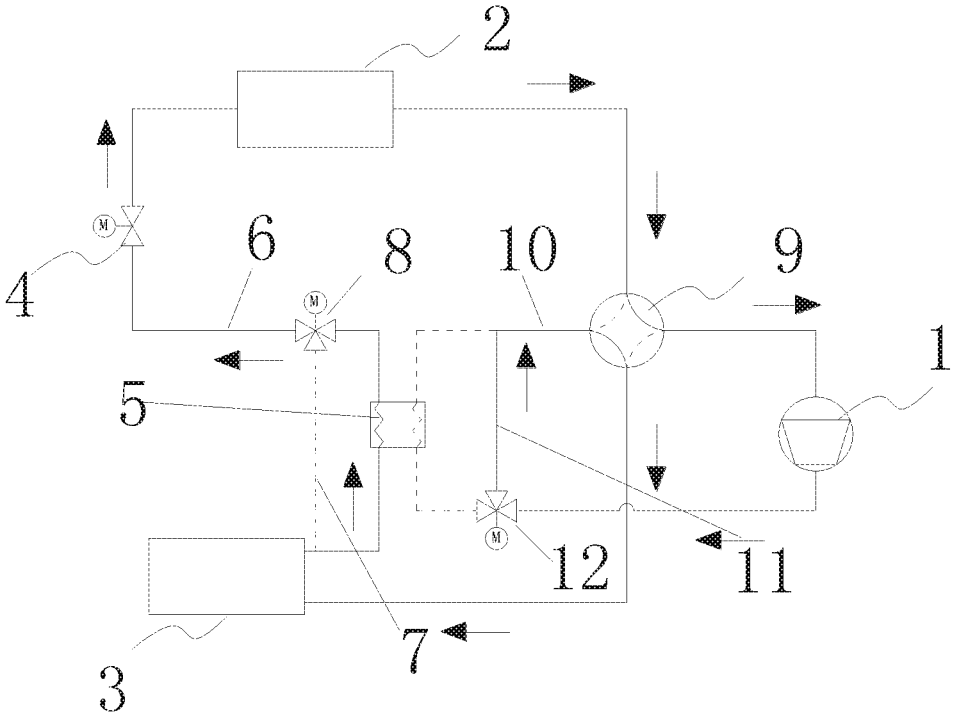
FIG. 7 is a schematic diagram illustrating the process flow of a fourth defrosting mode (defrosting alone without heat storage) of the heat pump air conditioning system of the present application.
Figure 8:
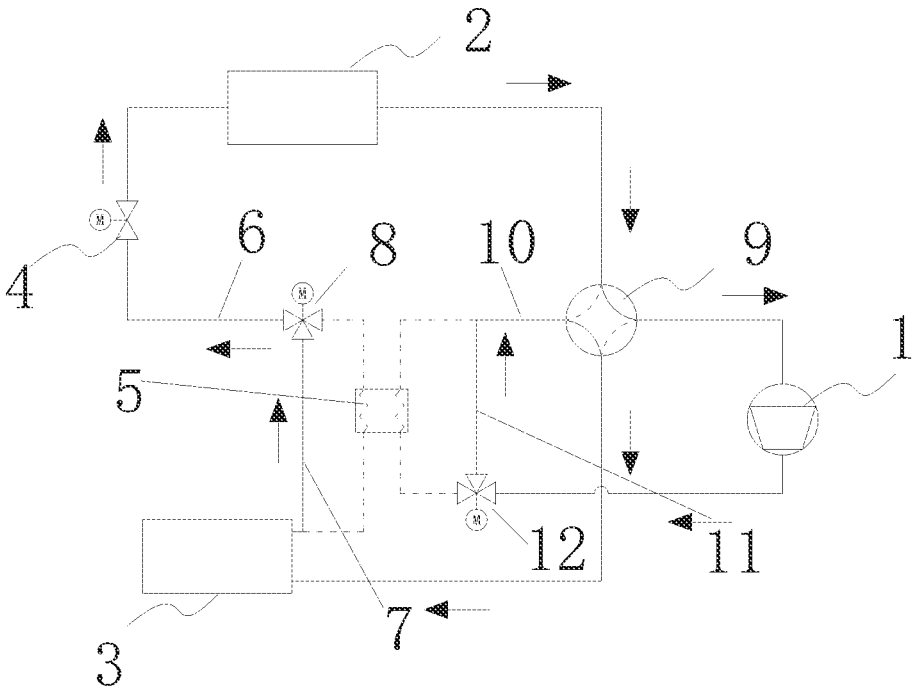
FIG. 8 is a schematic diagram illustrating the process flow of refrigeration of the heat pump air conditioning system of the present application.

As shown in FIGS. 1 to 8, the present application provides a heat pump air conditioning system, which includes:

a compressor 1;

an indoor unit heat exchanger 2, an outdoor unit heat exchanger 3 and a throttling device 4;

a refrigerant circulation loop connecting the compressor 1, the indoor unit heat exchanger 2, the outdoor unit heat exchanger 3 and the throttling device 4 in series;

a heat storage module 5 disposed in the refrigerant circulation loop and configured to absorb heat from refrigerant in the refrigerant circulation loop and store heat when heat storage is required, and to heat the refrigerant in the refrigerant circulation loop when the outdoor unit heat exchanger is defrosted.

By arranging the heat storage module in the refrigerant circulation loop, the heat storage module absorbs heat from the refrigerant in the refrigerant circulation loop and stores heat when heat storage is required, and heats the refrigerant in the refrigerant circulation loop when the outdoor unit heat exchanger needs to be defrosted, so that excess heat of the system can be stored for defrosting when an indoor heat load is low. During the defrosting process, heat is released by the heat storage module for defrosting. At this time, the heat can be continuously supplied to a room to ensure that room temperature remains unchanged, improving comfort of the room; moreover, when the indoor heat load is high, a heat demand can be guaranteed preferentially, and the four-way selector valve does not need to be reversed.

In an embodiment, a pipeline between the outdoor unit heat exchanger 3 and the throttling device 4 is a first pipeline 6, and the heat storage module 5 is connected to and arranged on the first pipeline 6 between the outdoor unit heat exchanger 3 and the throttling device 4;

alternatively, a pipeline between the outdoor unit heat exchanger 3 and a suction port of the compressor 1 is the first pipeline 6, and the heat storage module 5 is connected to and arranged on the first pipeline 6.

By providing the first pipeline between the throttling device and the outdoor unit heat exchanger, or providing the first pipeline between the outdoor unit heat exchanger and the suction port of the compressor, the refrigerant in the low-pressure side can flow through the heat storage module to supply heat for defrosting, so that the room temperature will not drop as far as possible during defrosting.

In an embodiment, a first parallel pipeline 7 is arranged at both ends of the heat storage module 5 in parallel; one end of the first parallel pipeline 7 is connected to a first position of the first pipeline 6, where one end of the heat storage module 5 is located; another end of the first parallel pipeline 7 is connected to a second position of the first pipeline 6, where another end of the heat storage module 5 is located; and a first control valve is further provided and configured to control one of the heat storage module 5 and the first parallel pipeline 7 to be open and control another to be closed.

By providing the first control valve and the first parallel pipeline between the throttling device and the outdoor unit heat exchanger, or configuring the pipeline between the outdoor unit heat exchanger and the suction port of the compressor as the first pipeline, the refrigerant from the indoor unit heat exchanger can be controlled by the first control valve to flow through the heat storage module first or not after flowing through an expansion valve. During defrosting, the refrigerant from the indoor unit heat exchanger flows through the expansion valve and enters the heat storage module to absorb heat, and then flows into the outdoor unit heat exchanger, releasing heat and defrosting the outdoor unit heat exchange. During heating, the refrigerant from the indoor unit heat exchanger flows through the expansion valve and directly flows into the outdoor unit heat exchanger to absorb heat, thus achieving an effective control of whether heat is absorbed from the heat storage module for defrosting (the heat storage module is turned off during conventional heating and refrigeration).

In an embodiment, the first control valve is a first three-way valve 8, and is disposed at a position where the first parallel pipeline 7 and the first pipeline 6 are connected. The specific structures of the first control valve of the present application is shown in FIGS. 1 to 8, and through controlling the first three-way valve the refrigerant in a low-pressure side can be controlled to flow through the heat storage module to absorb heat, or not to flow through the heat storage module.

In an embodiment,

A four-way valve 9 is further provided; the four-way valve 9 includes a first connection end, a second connection end, a third connection end and a fourth connection end; the first connection end and the indoor unit heat exchanger 2 are connected; the second connection end and an exhaust port of the compressor 1 are connected; the third connection end and the outdoor unit heat exchanger 3 are connected; and the fourth connection end and the suction port of the compressor 1 are connected. By providing the four-way valve, the refrigeration mode and the heating mode of the heat pump air conditioning system can be effectively controlled and switched to realize a dual mode of refrigeration and heating.

In an embodiment, a connection pipeline between the second connection end of the four-way valve 9 and the exhaust port of the compressor 1 is a second pipeline 10; and the heat storage module 5 is disposed on the second pipeline 10 as well; and the second pipeline 10 passes through the heat storage module 5. By further providing the second pipeline between the four-way valve and the exhaust port of the compressor, and by arranging the second pipeline to pass through the heat storage module, heat can be released to the heat storage module through a portion of the second pipeline passing through the heat storage module, thus achieving an effect of heat storage to provide stored energy for defrosting.

In an embodiment, a second parallel pipeline 11 is arranged at both ends of the heat storage module 5 in parallel; one end of the second parallel pipeline 11 is connected to a first position of the second pipeline 10, where one end of the heat storage module 5 is located; another end of the second parallel pipeline 11 is connected to a second position of the second pipeline 10, where another end of the heat storage module 5 is located; and a second control valve is further provided and configured to control one of the heat storage module 5 and the second parallel pipeline 11 to be open and control another to be closed.

By providing the heat storage module, exhaust gas of the compressor can be controlled by the second control valve to flow through the heat storage module or not. When the indoor heat load is less than the heat supply capacity of the system, the exhaust gas of the compressor flows through the heat storage module, and the heat storage module absorbs the heat of the exhaust gas of the compressor and stores the excess heat of the storage system. When the indoor heat load is greater than or equal to the heat supply capacity of the system, the exhaust gas of the compressor does not flow through the heat storage module, but flows directly into the indoor unit heat exchanger to supply heat to the room, thus achieving a selection of controlling the refrigerant to flow through the heat storage module or not according to a magnitude of the load, and achieving functions and effects that heat is not stored when the load is large, and that heat is stored when the load is small.

In an embodiment, the second control valve is a second three-way valve 12, and is disposed at a position where the second parallel pipeline 11 and the second pipeline 10 are connected. The specific structures of the second control valve of the present application are shown in FIGS. 1 to 8, and through controlling the second three-way valve, the refrigerant in a high-pressure side can be controlled to flow through the heat storage module to release heat or not to flow through the heat storage module.

In an embodiment, the indoor unit heat exchanger 2 further includes an indoor unit fan. The indoor unit heat exchanger can be turned on by the indoor unit fan to make the refrigerant exchange heat in the room. This situation is suitable for heating the room while defrosting the outdoor unit heat exchanger. The heat for defrosting mainly comes from the heat released by the heat storage module on the first pipeline to the refrigerant. The indoor unit fan is turned off to adapted itself for defrosting the outdoor unit heat exchanger (by switching the four-way valve) while the indoor unit heat exchanger does not exchange heat, so as to reduce an indoor temperature. The heat for defrosting comes from the heat storage module on the first pipeline.

The heat pump air conditioning system of the present application includes the compressor, the four-way selector valve, the outdoor unit heat exchanger, the indoor unit heat exchanger, the expansion valve (the throttling device), the first three-way valve, the second three-way valve, the heat storage module, and other components.

Two heat exchange pipelines pass through the heat storage module. One of the heat exchange pipelines (the second pipeline 10) is controlled by the second three-way valve 12 to be in communication with the exhaust port of the compressor, and another port of the pipeline is in communication with the four-way selector valve. This heat exchange pipeline and another pipeline (the second parallel pipeline 11) controlled by the second three-way valve 12 are connected in parallel. Another heat exchange pipeline is controlled by the first three-way valve 8 to be in communication with the expansion valve, and another port of the other heat exchange pipeline is in communication with the outdoor unit heat exchanger. The other heat exchange pipeline and another pipeline (the first parallel pipeline 7) controlled by the first three-way valve 8 are connected in parallel. By controlling the first three-way valve 8 and the second three-way valve 12, the refrigerant can be controlled to flow through the two heat exchange pipelines passing through the heat storage module or not.

During heating, when the heat storage module stores heat, the refrigerant in the heat exchange pipeline controlled by the second three-way valve 12 is circulated, and a parallel branch pipeline (the second parallel pipeline 11) of the heat exchange pipeline controlled by the second three-way valve 12 is closed; the refrigerant in a parallel branch pipeline (the first parallel pipeline 7) controlled by the first three-way valve 8 is circulated, and the heat exchange pipeline controlled by the first three-way valve 8 is closed.

During heating, when the heat storage module does not store heat, the refrigerant in the heat exchange pipelines controlled by the first three-way valve 8 and the second three-way valve 12 is not circulated, and the refrigerant is circulated in the parallel branch pipelines controlled by the first three-way valve 8 and the second three-way valve 12.

During defrosting, the refrigerant in the heat exchange pipeline (the first pipeline 6) controlled by the first three-way valve 8 is circulated; the refrigerant in the parallel branch pipeline (the first parallel pipeline 7) is not circulated; and the refrigerant in the heat exchange pipeline (the second pipeline 10) controlled by the second three-way valve 12 may be circulated or not. When the four-way selector valve is not reversed, the heat can be continuously supplied to the room during defrosting; and when the four-way selector valve is reversed, the heat cannot be supplied to the room during defrosting, but before flowing into the indoor unit heat exchanger, the refrigerant flows through the heat storage module and absorbs heat, therefore the heat absorbed from the room is reduced, and indoor thermal comfort is also better than that achieved by traditional refrigeration cycle defrosting.

During refrigeration, the refrigerant in the heat exchange pipelines controlled by the first three-way valve 8 and the second three-way valve 12 are not circulated, and the refrigerant is circulated in the parallel branch pipelines controlled by the first three-way valve 8 and the second three-way valve 12.

Figure 9:
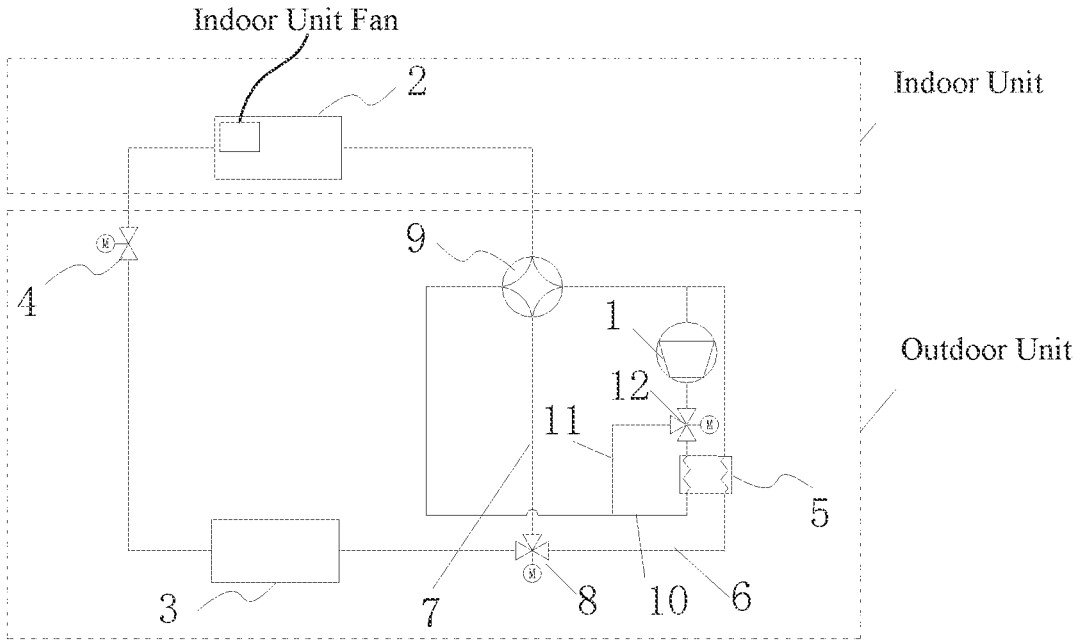
FIG. 9 is a schematic structural diagram illustrating a process flow of an alternative embodiment of the heat pump air conditioning system of FIG. 1.

The above embodiment is only a basic example and should not be a limitation of the present application. FIG. 9 is another embodiment, which differs from the above embodiment in that the heat exchange pipeline passing through the heat storage module and controlled by the first three-way valve 8 is in communication with the suction port of the compressor.

The present application further provides a control method for the air conditioning system. The control method is applied to any one of the heat pump air conditioning systems described above, and performs switching control for modes of refrigeration, heating, heating and heat storage, refrigeration and heat storage, defrosting alone, and heating and defrosting.

By arranging the heat storage module in the refrigerant circulation loop, the heat storage module absorbs heat from the refrigerant in the refrigerant circulation loop and stores heat when heat storage is required, and heats the refrigerant in the refrigerant circulation loop when the outdoor unit heat exchanger needs to be defrosted, so that excess heat of the system can be stored for defrosting when an indoor heat load is low. During the defrosting process, heat is released by the heat storage module for defrosting. At this time, the heat can be continuously supplied to a room to ensure that room temperature remains unchanged, improving comfort of the room; moreover, when the indoor heat load is high, a heat demand can be guaranteed preferentially, and the four-way selector valve does not need to be reversed, thus achieving switching control of modes of refrigeration, heating, heating and heat storage, refrigeration and heat storage, defrosting alone, and heating and defrosting for the air conditioning system.

In an embodiment, when the refrigeration is performed, the four-way valve 9 is controlled to regulate the indoor unit heat exchanger 2 to be in communication with the suction port of the compressor 1, and the first parallel pipeline 7 and the second parallel pipeline 11 are controlled to be open In this mode of refrigeration alone, the heat storage module is not required for heat storage or defrosting, so the first parallel pipeline and the second parallel pipeline are conrolled to be open, so as to achieve a short-circuit effect on the heat storage module.

When the heating is performed, the four-way valve 9 is controlled to regulate the indoor unit heat exchanger 2 to be in communication with the exhaust port of the compressor 1, and the first parallel pipeline 7 and the second parallel pipeline 11 are controlled to be open. In this mode of heating alone, the heat storage module is not required for heat storage or defrosting, so the first parallel pipeline and the second parallel pipeline are controlled to be opened to achieve a short-circuit effect on the heat storage module.

When the refrigeration and the heat storage are performed, the four-way valve 9 is controlled to regulate the indoor unit heat exchanger 2 to be in communication with the suction port of the compressor 1; the first parallel pipeline 7 is controlled to be open; and the second parallel pipeline 11 is controlled to be closed. In this mode of refrigeration and heat storage, the heat storage module is required for heat storage or defrosting, so the second parallel pipeline is closed, and the heat storage module disposed in the second pipeline is connected for the purpose of heat absorption and heat storage. At this time, defrosting is not required, and the first parallel pipeline is open to achieve a short-circuit effect on the heat storage module on the first pipeline.

When the heating and the heat storage are performed, the four-way valve 9 is controlled to regulate the indoor unit heat exchanger 2 to be in communication with the exhaust port of the compressor 1; the first parallel pipeline 7 is controlled to be open; and the second parallel pipeline 11 is contollred to be closed. This mode of heating and heat storage is basically identical with the mode of refrigeration and heat storage, except that a direction of the four-way valve needs to be switched, and that the heat storage module is required for heat storage or defrosting. Therefore, the second parallel pipeline is closed, and the heat storage module disposed on the second pipeline is connected for heat absorption and heat storage. At this time, defrosting is not required, and the first parallel pipeline is controlled to open to achieve a short-circuit effect on the heat storage module on the first pipeline.

When the defrosting alone is performed, the four-way valve 9 is controlled to regulate the indoor unit heat exchanger 2 to be in communication with the suction port of the compressor 1; the first parallel pipeline 7 is controlled to be closed, and the second parallel pipeline 11 is controlled to be closed or to be open. The defrosting alone means that the indoor heat exchanger does not heat during defrosting, but the indoor temperature should be ensured s not to decrease as far as possible. The first parallel pipeline 7 is controlled to be closed so as to turn on the heat storage module on the first pipeline, and the heat storage module releases heat and supplies heat to the refrigerant, thus achieving the purpose of defrosting the outdoor unit heat exchanger. At the same time the heat storage module on the second pipeline may operate to store heat or not.

When the heating and the defrosting are performed, the four-way valve 9 is controlled to regulate the indoor unit heat exchanger 2 to be in communication with the exhaust port of the compressor 1; the first parallel pipeline 7 is controlled to be closed; and the second parallel pipeline 11 is controlled to be closed or open. At this time, the indoor heat exchanger performs heating while defrosting, and the first parallel pipeline 7 is controlled to be closed to turn on the heat storage module on the first pipeline, and the heat storage module releases heat and supplies heat to the refrigerant, thus achieving the purpose of defrosting the outdoor unit heat exchanger. At the same time, the heat storage module on the second pipeline may operate to store heat or not, which does not affect the defrosting.

In an embodiment, when the defrosting alone is performed, the indoor unit fan is controlled to be turned off; and when heating and defrosting are performed, the indoor unit fan is controlled to be turned on. When defrosting alone is performed, the indoor unit heat exchanger is disposed at a low-pressure evaporation side, and it is very easy for the refrigerant flowing through the indoor unit heat exchanger to absorb heat from the indoor unit heat exchanger, thus resulting in a decrease in the indoor temperature. In order to avoid occurrence of this situation, in the present application, the indoor unit fan is controlled to be turned off, so that the indoor unit heat exchanger does not exchange heat or heat exchange efficiency thereof is quite low, thereby effectively guaranteeing the indoor temperature and improving comfort.

The above are only some embodiments of the present application, but not intended to limit the present application. Any modification, equivalent replacement, and improvement, etc. made within the spirit and the principle of the present application, are all supposed to be within the protection scope of the present application. What descirbed above are only some embodiments of the present application, and it should be noted that, for those of ordinary skill in the art, various improvements and modifications can be made without departing from the technical principles of the present application. These improvements and modifications should also be regarded as the protection scope of the present application.

What is claimed is:

1. A heat pump air conditioning system, comprising:

a compressor;

an indoor unit heat exchanger, an outdoor unit heat exchanger and a throttling device;

a refrigerant circulation loop, connecting the compressor, the indoor unit heat exchanger, the outdoor unit heat exchanger and the throttling device in series;

a heat storage module, disposed in the refrigerant circulation loop and configured to absorb heat from refrigerant in the refrigerant circulation loop;

a pipeline between the outdoor unit heat exchanger and the throttling device is a first pipeline, and the heat storage module is connected to and arranged on the first pipeline between the outdoor unit heat exchanger and the throttling device;

a first parallel pipeline is arranged at both ends of the heat storage module in parallel; one end of the first parallel pipeline is connected to a first position of the first pipeline, where one end of the heat storage module is located; another end of the first parallel pipeline is connected to a second position of the first pipe, where another end of the heat storage module is located; and a first control valve is further provided and configured to control one of the heat storage module and the first parallel pipeline to be open and control another to be closed.

2. The heat pump air conditioning system of claim 1, wherein, the first control valve is a first three-way valve, and is disposed at a position where the first parallel pipeline and the first pipeline are connected.

3. The heat pump air conditioning system of claim 1, wherein, the system further comprises a four-way valve; the four-way valve comprises a first connection end, a second connection end, a third connection end and a fourth connection end; the first connection end and the indoor unit heat exchanger are connected; the second connection end and an exhaust port of the compressor are connected; the third connection end and the outdoor unit heat exchanger are connected; and the fourth connection end and a suction port of the compressor are connected.

4. The heat pump air conditioning system of claim 3, wherein, a connection pipeline between the second connection end of the four-way valve and the exhaust port of the compressor is a second pipeline; the heat storage module is disposed on the second pipeline as well; and the second pipeline passes through the heat storage module.

5. The heat pump air conditioning system of claim 4, wherein, a second parallel pipeline is arranged at both ends of the heat storage module in parallel; one end of the second parallel pipeline is connected to a first position of the second pipeline, where one end of the heat storage module is located; another end of the second parallel pipeline is connected to a second position of the second pipeline, where another end of the heat storage module is located; and a second control valve is further provided and configured to control one of the heat storage module and the second parallel pipeline to be open and control another to be closed.

6. The heat pump air conditioning system of claim 5, wherein, the second control valve is a second three-way valve, and is disposed at a position where the second parallel pipeline and the second pipeline are connected.

7. The heat pump air conditioning system of claim 3, wherein, a pipeline between the outdoor unit heat exchanger and the throttling device is a first pipeline, and the heat storage module is connected to and arranged on the first pipeline between the outdoor unit heat exchanger and the throttling device.

8. The heat pump air conditioning system of claim 7, wherein, a first parallel pipeline is arranged at both ends of the heat storage module in parallel; one end of the first parallel pipeline is connected to a first position of the first pipeline, where one end of the heat storage module is located; another end of the first parallel pipeline is connected to a second position of the first pipe, where another end of the heat storage module is located; a first control valve is further provided and configured to control one of the heat storage module and the first parallel pipeline to be open and control another to be closed.

9. The heat pump air conditioning system of claim 8, wherein, the first control valve is a first three-way valve, and is disposed at a position where the first parallel pipeline and the first pipeline are connected.

10. The heat pump air conditioning system of claim 3, wherein, a pipeline between the outdoor unit heat exchanger and a suction port of the compressor is a first pipeline, and the heat storage module is connected to and arranged on the first pipeline.

11. The heat pump air conditioning system of claim 10, wherein, a first parallel pipeline is arranged at both ends of the heat storage module in parallel; one end of the first parallel pipeline is connected to a first position of the first pipeline, where one end of the heat storage module is located; another end of the first parallel pipeline is connected to a second position of the first pipe, where another end of the heat storage module is located; a first control valve is further provided and configured to control one of the heat storage module and the first parallel pipeline to be open and control another to be closed.

12. The heat pump air conditioning system of claim 11, wherein, the first control valve is a first three-way valve, and is disposed at a position where the first parallel pipeline and the first pipeline are connected.

13. The heat pump air conditioning system of claim 1, wherein, the indoor unit heat exchanger further comprises an indoor unit fan.

14. The heat pump air conditioning system of claim 1, wherein, the indoor unit heat exchanger further comprises an indoor unit fan.

15. A control method for an air conditioning system, wherein, the control method is applied to the heat pump air conditioning system of claim 1;

when the refrigeration is performed, a four-way valve is controlled to regulate the indoor unit heat exchanger to be in communication with a suction port of the compressor, and a first parallel pipeline and a second parallel pipeline are controlled to be open;

when the heating is performed, the four-way valve is controlled to regulate the indoor unit heat exchanger to be in communication with an exhaust port of the compressor, and the first parallel pipeline and the second parallel pipeline are controlled to be open; and when the heating and the defrosting are performed, the four-way valve is controlled to regulate the indoor unit heat exchanger to be in communication with the exhaust port of the compressor; the first parallel pipeline is controlled to be closed; and the second parallel pipeline is controlled to be closed or open.

16. The control method of claim 15, wherein, when the refrigeration and the heat storage are performed, the four-way valve is controlled to regulate the indoor unit heat exchanger to be in communication with the suction port of the compressor; the first parallel pipeline is controlled to be open; and the second parallel pipeline is controlled to be closed;

when the heating and the heat storage are performed, the four-way valve is controlled to regulate the indoor unit heat exchanger to be in communication with the exhaust port of the compressor; the first parallel pipeline is controlled to be open; and the second parallel pipeline is controlled to be closed; and when a defrosting alone is performed, the four-way valve is controlled to regulate the indoor unit heat exchanger to be in communication with the suction port of the compressor; the first parallel pipeline is controlled to be closed; and the second parallel pipeline is controlled to be closed or open.

17. The control method of claim 16, wherein, when the defrosting alone is performed, the indoor unit fan is controlled to be turned off; and when the heating and the defrosting are performed, the indoor unit fan is controlled to be turned on.

18. A heat pump air conditioning system, comprising:

a compressor;

an indoor unit heat exchanger, an outdoor unit heat exchanger and a throttling device;

a refrigerant circulation loop, connecting the compressor, the indoor unit heat exchanger, the outdoor unit heat exchanger and the throttling device in series;

a heat storage module, disposed in the refrigerant circulation loop and configured to absorb heat from refrigerant in the refrigerant circulation loop;

a pipeline directly connected between the outdoor unit heat exchanger and a suction port of the compressor is a first pipeline, and the heat storage module is connected to and arranged on the first pipeline;

a first parallel pipeline is arranged at both ends of the heat storage module in parallel; one end of the first parallel pipeline is connected to a first position of the first pipeline, where one end of the heat storage module is located; another end of the first parallel pipeline is connected to a second position of the first pipe, where another end of the heat storage module is located; and a first control valve is further provided and configured to control one of the heat storage module and the first parallel pipeline to be open and control another to be closed.

* * * * *